US011425479B2

(12) United States Patent
Liu et al.

(10) Patent No.: US 11,425,479 B2
(45) Date of Patent: Aug. 23, 2022

(54) IN-EAR AUDIO DEVICE WITH INTERCHANGEABLE FACEPLATE

(71) Applicant: Logitech Europe S.A., Lausanne (CH)

(72) Inventors: Vincent Liu, Irvine, CA (US); Johnny Hsu, Hsinchu (TW); Philippe Depallens, San Clemente, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 49 days.

(21) Appl. No.: 16/883,809

(22) Filed: May 26, 2020

(65) Prior Publication Data

US 2021/0377641 A1 Dec. 2, 2021

(51) Int. Cl.
*H04R 1/10* (2006.01)

(52) U.S. Cl.
CPC ..... *H04R 1/1016* (2013.01); *H04R 1/105* (2013.01); *H04R 1/1066* (2013.01); *H04R 1/1091* (2013.01); *H04R 1/1033* (2013.01)

(58) Field of Classification Search
CPC ..... H04R 1/10; H04R 1/1016; H04R 25/556; H04R 25/65
See application file for complete search history.

(56) References Cited

U.S. PATENT DOCUMENTS 2,595,672 A * 5/1952 Greenwood ..... H04R 25/65 381/322
3,598,928 A * 8/1971 Hickox ..... H04R 25/609 381/324
5,056,204 A 10/1991 Bartschi
5,184,306 A 2/1993 Erdman et al.
5,333,622 A 8/1994 Casali et al.
5,487,012 A 1/1996 Topholm et al.
5,631,965 A 5/1997 Chang et al.
6,401,859 B1 6/2002 Widmer et al.
6,432,247 B1 8/2002 Juneau et al.
6,473,512 B1 10/2002 Juneau et al.
6,540,045 B1 4/2003 Widmer et al.
6,695,943 B2 2/2004 Juneau et al.
7,050,876 B1 5/2006 Fu et al.
7,084,870 B2 8/2006 Fang et al.
7,286,679 B2 10/2007 Fang et al.
7,308,328 B2 12/2007 Fang et al.
(Continued)

FOREIGN PATENT DOCUMENTS

CN 201718018 U * 1/2011
WO 2012/129229 A2 9/2012
(Continued)

*Primary Examiner* — Ryan Robinson
(74) *Attorney, Agent, or Firm* — Patterson & Sheridan, LLP

(57) ABSTRACT

An in-ear audio device includes a driver module disposed within an in-ear enclosure, and a mounting region of the in-ear enclosure including a device engagement mechanism comprising an engagement feature that is formed on a surface of the in-ear enclosure. The driver module is configured to deliver audible output provided from the driver module to an output end of the in-ear enclosure. At least a portion of the engagement feature is configured to engage with a mating engagement feature of an interchangeable faceplate to cause the interchangeable faceplate to be coupled to the engagement feature.

21 Claims, 12 Drawing Sheets

(56) References Cited

U.S. PATENT DOCUMENTS

| | | | | |
|---|---|---|---|---|
| 7,317,806 | B2 | 1/2008 | Harvey et al. | |
| 7,421,087 | B2 | 9/2008 | Perkins et al. | |
| 7,447,556 | B2 | 11/2008 | McBagonlur et al. | |
| 7,489,794 | B2 | 2/2009 | Harvey | |
| 7,571,018 | B2 | 8/2009 | Roth et al. | |
| 7,634,099 | B2 | 12/2009 | Harvey et al. | |
| 8,032,337 | B2 | 10/2011 | Deichmann et al. | |
| 8,194,911 | B2 | 6/2012 | Dyer et al. | |
| 8,841,603 | B1 | 9/2014 | Blanton et al. | |
| 8,900,125 | B2 | 12/2014 | Berglund et al. | |
| 8,900,127 | B2 | 12/2014 | Berglund et al. | |
| 8,900,128 | B2 | 12/2014 | Berglund et al. | |
| 8,900,129 | B2 | 12/2014 | Berglund et al. | |
| 8,900,130 | B2 | 12/2014 | Berglund et al. | |
| 9,042,589 | B2 | 5/2015 | Depallens et al. | |
| 9,313,568 | B2 * | 4/2016 | Basseas | H04L 61/2514 |
| 9,723,394 | B2 | 8/2017 | Anderson et al. | |
| 9,820,064 | B1 * | 11/2017 | Schumaier | H04R 25/658 |
| 9,888,309 | B2 * | 2/2018 | Prelogar | H04R 1/1041 |
| 9,967,649 | B2 | 5/2018 | Chandramohan et al. | |
| 10,003,880 | B2 | 6/2018 | Wagman et al. | |
| 10,194,229 | B2 * | 1/2019 | Toelle | H04R 1/1058 |
| 10,244,304 | B1 * | 3/2019 | Parng | H04R 1/1058 |
| 10,659,862 | B1 | 5/2020 | Rugolo | |
| 10,667,064 | B2 * | 5/2020 | Ruaro | H04R 25/554 |
| 10,939,194 | B2 * | 3/2021 | Moudgill | H04R 1/1016 |
| 11,026,009 | B2 * | 6/2021 | Ma | H04R 1/1016 |
| 2003/0123687 | A1 * | 7/2003 | Petrick | H04R 25/609 381/322 |
| 2004/0069560 | A1 | 4/2004 | Widmer | |
| 2006/0133636 | A1 | 6/2006 | Harvey et al. | |
| 2006/0188119 | A1 | 8/2006 | Parker | |
| 2007/0036385 | A1 | 2/2007 | Harvey et al. | |
| 2007/0121980 | A1 | 5/2007 | Menzl | |
| 2009/0173353 | A1 | 7/2009 | Purcell et al. | |
| 2011/0058702 | A1 | 3/2011 | Saggio, Jr. | |
| 2011/0228963 | A1 | 9/2011 | Goldstein et al. | |
| 2012/0028107 | A1 | 2/2012 | Sugita et al. | |
| 2012/0155689 | A1 | 6/2012 | Milodzikowski et al. | |
| 2014/0313506 | A1 | 10/2014 | Bergman et al. | |
| 2015/0038850 | A1 | 2/2015 | Hatzilias et al. | |
| 2015/0038871 | A1 | 2/2015 | Hatzilias et al. | |
| 2015/0038880 | A1 | 2/2015 | Hatzilias et al. | |
| 2015/0039087 | A1 | 2/2015 | Hatzilias et al. | |
| 2015/0057533 | A1 | 2/2015 | Bergman et al. | |
| 2015/0067929 | A1 | 3/2015 | Blanton et al. | |
| 2015/0097929 | A1 | 4/2015 | Bergman et al. | |
| 2015/0097931 | A1 | 4/2015 | Hatzilias et al. | |
| 2015/0097935 | A1 | 4/2015 | Hatzilias et al. | |
| 2015/0097968 | A1 | 4/2015 | Bergman et al. | |
| 2015/0098636 | A1 | 4/2015 | Bergman et al. | |
| 2015/0099981 | A1 | 4/2015 | Cahall et al. | |
| 2015/0099983 | A1 | 4/2015 | Hatzilias et al. | |
| 2015/0190043 | A1 | 7/2015 | Hatzilias | |
| 2016/0051134 | A1 | 2/2016 | Hatzilias | |
| 2017/0195808 | A1 | 7/2017 | Higgins et al. | |
| 2021/0144460 | A1 * | 5/2021 | Mori | H04R 1/1025 |
| 2021/0144493 | A1 * | 5/2021 | Thumm | H04R 25/609 |

FOREIGN PATENT DOCUMENTS

| | | | |
|---|---|---|---|
| WO | 2013/138078 | A2 | 9/2013 |
| WO | 2013/138079 | A3 | 9/2013 |
| WO | 2015/030861 | A1 | 3/2015 |
| WO | 2015/030862 | A1 | 3/2015 |

* cited by examiner

IN-EAR AUDIO DEVICE WITH INTERCHANGEABLE FACEPLATE

BACKGROUND

Field

Embodiments of the present disclosure generally relate to a custom fit in-ear audio device, and more specifically, to a custom fit in-ear audio device with an interchangeable or replaceable element.

Description of the Related Art

In-ear audio devices provide an enhanced listening experience for studio recording, stage performance, and audiophile listening. In-ear audio devices may be hard-wired or wirelessly connected to an external audio source or connected directly to a transmitter such as a mixer or an amplifier. An in-ear audio device generally includes a shell, or a case that contacts the external ear canal of a user, and a driver assembly, which includes drivers, a crossover circuit, and other relevant components. In-ear audio devices may be formed in a one-size and shape fits all configuration, or they may be customized to fit a user's ear. In-ear audio devices may be also be formed in many different configurations to meet a user's preference relative to sound quality, and/or to fit a user's aesthetic style or different intended personal functional uses.

Most in-ear audio devices on the market today include a single utilitarian shape, color or ornamental design that is not able to be altered to meet a user's aesthetic style or be customized to better meet the different physical or social activities a user may desire to complete. However, in some cases, in-ear audio devices have included additional external components that are affixed to the main functional elements of an in-ear audio device to alter the external shell of the in-ear audio device. However, due to small sizes of in-ear audio devices, the mounting of these conventional external component(s) was often easily damaged during normal use and thus often required them to be fixedly attached due to the need to make sure that the external components were able to remain affixed during times when various physical activities were being performed.

Therefore, there is a need for an in-ear audio device design that solves the problems described above. Also, there is a need for an in-ear audio device design that allows the in-ear audio device to be easily customized multiple times by use of different exchangeable elements, without scarifying comfort and sound quality of the in-ear audio device.

SUMMARY

Embodiments of the present disclosure generally relate to an in-ear audio device that includes a driver module disposed within an in-ear enclosure, and a mounting region of the in-ear enclosure including a device engagement mechanism comprising an engagement feature that is formed on a surface of the in-ear enclosure. The driver module is configured to deliver audible output provided from the driver module to an output end of the in-ear enclosure. At least a portion of the engagement feature is configured to engage with a mating engagement feature of an interchangeable faceplate to cause the interchangeable faceplate to be coupled to the engagement feature.

Embodiments of the present disclosure may also provide an in-ear audio device that includes a driver module disposed within a cavity region which is partially defined by a shell body, and a cap plate having a front surface and a back surface opposite to the front surface. The cap plate includes a device engagement mechanism including an engagement feature that is formed in the front surface. The back surface defines a portion of the cavity region when the cap plate is positioned against a cap mounting surface of the shell body. The driver module includes one or more drivers and one or more sound tubes. A first end of the one or more sound tubes is positioned to receive an audible output generated by the one or more drivers. A second end of the one or more sound tubes is positioned to deliver the audible output provided from the driver to an output face of the shell body. At least a portion of the engagement feature is configured to engage with a mating engagement feature of an interchangeable faceplate to cause the interchangeable faceplate to be coupled to the cap plate.

Embodiments of the present disclosure also generally relate to an in-ear audio device that includes a shell body of an in-ear audio device and a cap plate configured to seal an opening of the shell body. The cap plate includes an engagement feature having one or more notches and one or more ridges formed on a mounting region on a front surface of the cap plate. The one or more notches of the engagement feature are configured to receive one or more bayonet tabs of an interchangeable faceplate.

Embodiments of the present disclosure also generally relate to an interchangeable faceplate for mounting on an in-ear audio device that includes a plate having a first surface and a second surface opposite the first surface; and a device engagement mechanism formed on the first surface of the plate, the device engagement mechanism comprising one or more engagement features. The one or more bayonet tabs are configured to interlock with an engagement feature formed on a cap plate of an in-ear monitor, and the one or more bayonet tabs are configured to be positioned within one or more notches formed in the engagement feature of the cap plate.

Embodiments of the present disclosure may also provide an interchangeable faceplate to be mounted on an in-ear monitor that includes a plate having a first surface and a second surface opposite the first surface and an attachment ring formed on the first surface of the plate. The attachment ring includes one or more bayonet tabs. The one or more bayonet tabs are configured to interlock with an engagement feature formed on a cap plate of an in-ear monitor, wherein the one or more bayonet tabs are configured to be positioned within one or more notches formed in the engagement feature of the cap plate.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to an in-ear audio device that can be easily customized to fit a user's aesthetic style or better meet the various intended uses desired by the user, without scarifying comfort and sound quality. Embodiments of the disclosure will include a custom in-ear audio device that includes one or more external exchangeable components, which for simplicity of discussion is referred to herein as an interchangeable faceplate or simply a faceplate.

In-ear audio devices described herein can be customized to fit a particular user (e.g., size and shape of the ear, desired sound qualities, intended uses) and are equipped to receive an interchangeable faceplate on the outmost surface of the in-ear audio devices. The novel design disclosed herein allows many different interchangeable faceplates to be separately positioned on and/or supported by the in-ear audio device at different times. In some embodiments, an interchangeable faceplate is engaged with a portion of an in-ear audio device by use of a device engagement mechanism, such as a twist-lock mechanism, that can be miniaturized without sacrificing comfort and sound quality of the in-ear audio device.

In-Ear Audio Device Assembly

Figure 1:
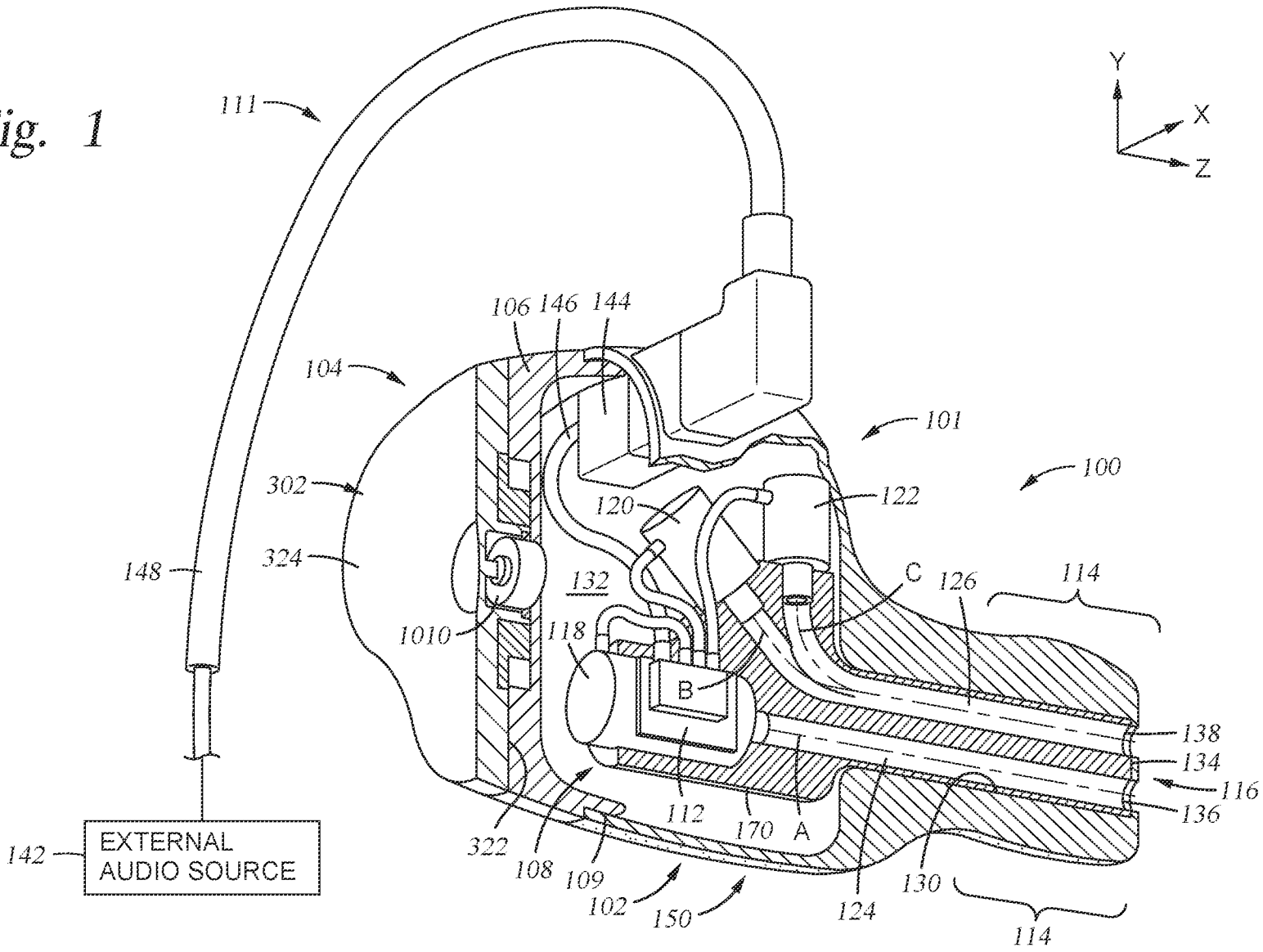
FIGS. 1 and 2 are cross-sectional views of an in-ear audio device, according to an embodiment.
Figure 2:
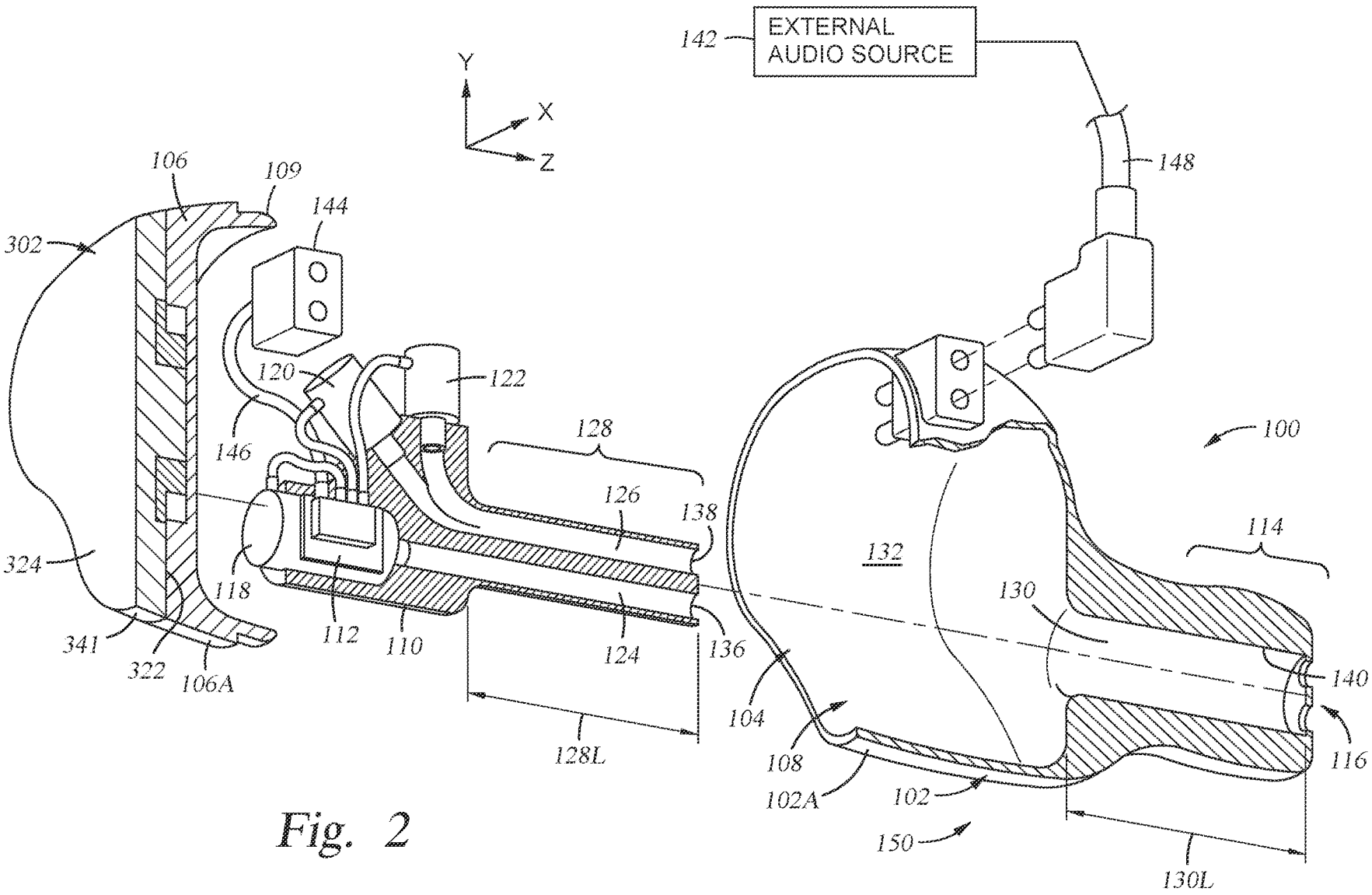
Figure 3B:
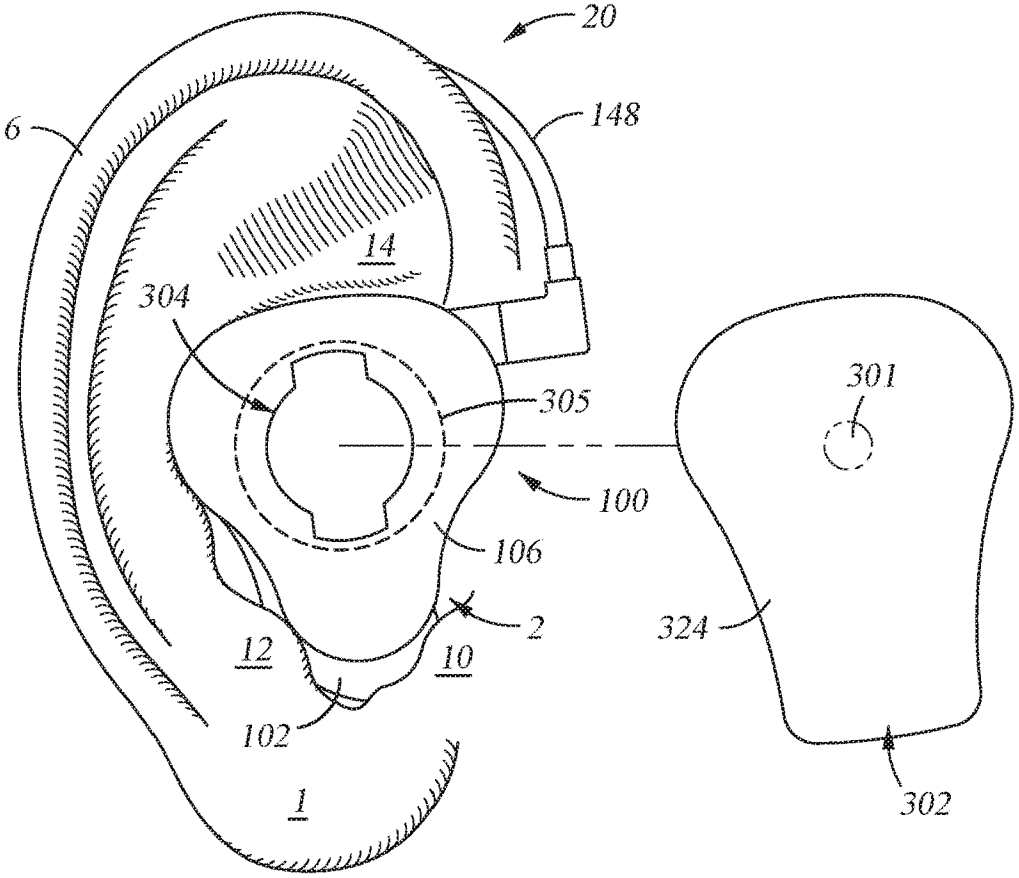
FIGS. 3A and 3B are schematic views of an in-ear audio device disposed within a user's ear, according to one embodiment.
Figure 3A:
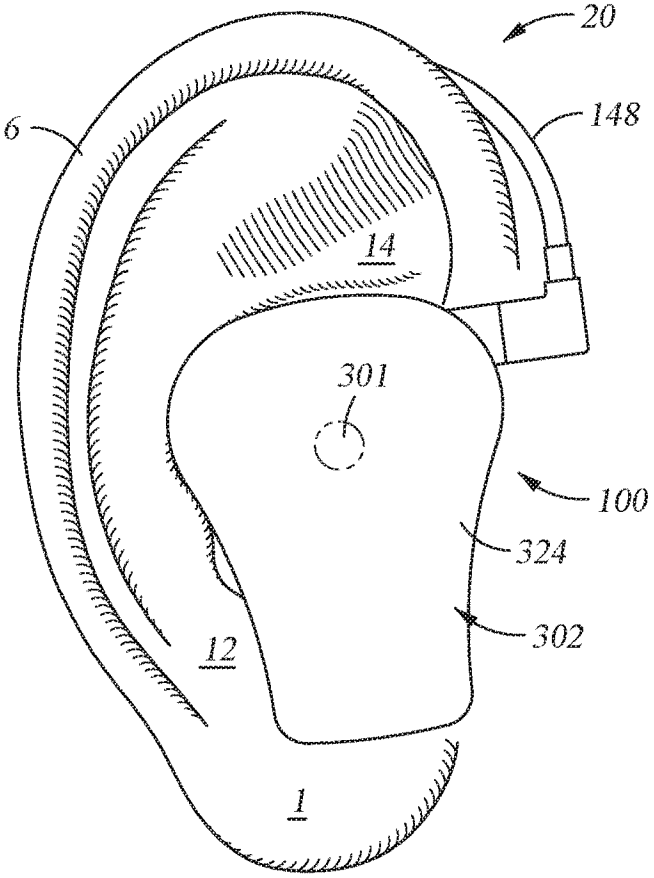

FIGS. 1 and 2 are side cross-sectional views of an in-ear audio device 100, according to one embodiment. The in-ear audio device 100 includes an in-ear enclosure 101 that includes a cap plate 106 and a shell body 102 that has an opening 104. The cap plate 106 fits over the opening 104 formed in the shell body 102. Within a cavity 108 of the in-ear enclosure 101, which is defined by the shell body 102 and the cap plate 106, a driver module 110 and a crossover circuit 112 are housed. The cap plate 106 includes a cap mounting surface 109. The cap mounting surface 109 on the back surface 308 of the cap plate 106 is typically sealably bonded to the supporting edge surface of the opening 104 of the shell body 102 and seals the shell body 102 after various audio device components, such as the driver module 110 and the crossover circuit 112, have been inserted into the shell body 102 through the opening 104 to prevent water, sweat or other fluids positioned outside of the in-ear audio device 100 from making their way into the cavity 108. When the in-ear audio device 100 is worn by a user, an inner ear portion 114 of the shell body 102 will typically be positioned inside the ear canal of the user such that an output face 116 of the shell body 102 (that is, an output end of the in-ear audio device 100) faces the eardrum of the user. A representation of an in-ear audio device 100 inserted within a user's ear is illustrated in FIGS. 3A-3B. The in-ear audio device 100 can include an in-ear monitor (IEM). Suitable IEMs may include one or more balanced armature drivers and/or one or more dynamic drivers.

The driver module 110 includes a plurality of drivers 118, 120, 122 and sound tubes 124, 126 that are formed in a module body 128, and is coupled to and/or positioned within the shell body 102 at the output face 116 of the shell body 102. The module body 128 is disposed within a first cavity region 130 defined within the cavity 108 by the inner ear portion 114 of the shell body 102. In general, the inner ear portion 114 is configured to be positioned within a portion of a user's ear canal, as discussed above. The drivers 118, 120, 122 and the crossover circuit 112 are disposed in a second cavity region 132 that forms the reminder of the cavity 108. The sound tubes 124, 126 are formed at least partially through the module body 128 of the driver module 110 and terminate at an output end 134 of the driver module 110. While in FIGS. 1 and 2, three drivers 118, 120, 122 are shown, in some embodiments, the in-ear audio device 100 includes any number of drivers. In the example shown in FIGS. 1 and 2, the sound tube 124 is coupled to an output of the driver 118, and the sound tube 126 is coupled to outputs of the drivers 120 and 122. However, in some embodiments, the driver module 110 includes more than two sound tubes and sound bores that are formed in the module body 128. For example, each of the three drivers 118, 120, 122 are connected to separate sound tubes formed within the module body 128 of the driver module 110. In other examples, the module body 128 of the driver module 110 includes only one sound tube and one sound bore that are coupled to one or more drivers. The in-ear audio device 100 may include one or more holes or passages (not shown) that extend through the cap plate 106 or the shell body 102 and into the sound tubes 124, 126 to help account for ambient noise.

Distances A, B, C between the output end 134 of the driver module 110 to outputs of the respective drivers 118, 120, 122 and cross-sectional areas (e.g., circular diameters) of the sound tubes 124 and 126 may each be selected so that they provide reproducible high quality sound within a desired frequency range with minimal distortion. In some embodiments, a length 128L of the module body 128 of the driver module 110 and the distances A, B, C of the sound tubes 124 and 126 are fixed to a standard size so that the sound tubes 124 and 126 can fit within the module body 128 of the driver module 110 and then be reliably positioned relative to or against the output face 116 when the shell body 102 is customized based on differing shapes and sizes of users' ears. In some embodiments, the first cavity region 130 is formed such that a length 130L of the first cavity region 130 is less than the length 128L of the module body 128 to allow the output end 134 of the driver module 110 to be reliably positioned relative to or against the output face 116, for all manufactured in-ear audio devices 100 regardless of shapes and sizes of users' ears. In some embodiments, size and shape of the cavity 108 are adjusted in the in-ear audio device 100 to compensate for the fixed length of the driver module 110 such that the in-ear audio device 100 matches a user's ear. Alternately, in some embodiments, the length 128L of the module body 128 of the driver module 110 and properties of the sound tubes 124 and 126 are adjusted based on shape and size of a user's ear.

In the example shown in FIGS. 1 and 2 in which the driver 118 is coupled to output face 116 via sound bore 136, and the drivers 120 and 122 are coupled to output face 116 via sound bore 138, the driver 118 may be a high-frequency driver, the driver 120 may be a mid-frequency driver, and the driver 122 may be a low-frequency driver. In this configuration, the sound tube 124 and the sound bore 136 may have a larger cross-sectional area than the sound tube 126 and sound bore 138. In some embodiments, an outer diameter of the module body 128 of the driver module 110 is larger than a corresponding diameter of the first cavity region 130 to provide an interference type of fit. The desirable fit between the module body 128 of the driver module 110 and the outer surface 140 of the first cavity region 130 of the shell body 102 can be used to limit unwanted movement, vibrations and damage of components in the driver module 110 during normal use. In some embodiments, the driver module 110, or module body 128 of the driver module 110, is formed of a material with a different rigidity from the inner ear portion 114 of the in-ear audio device 100. In some embodiments, the module body 128 of the driver module 110, or module body 128 (FIG. 2) of the driver module 110, has a lower rigidity than the inner ear portion 114 to allow some compression to occur in the module body 128 when it is inserted into the first cavity region 130 so that the driver module 110 can be desirably positionally retained due to a friction created between these parts within the in-ear audio device 100. The difference in rigidity between at least a portion of the module body 128 of the driver module 110 and the inner ear portion 114 of the shell body 102 may be accomplished by a structural design of either of the components (e.g., wall thickness of each component) or by selection of materials having differing mechanical properties. In some embodiments, the module body 128 of the driver module 110 is formed from a flexible polymeric material while the shell body 102 is formed of a more rigid polymeric material. In some embodiments, at least a portion of the module body 128 of the driver module 110 formed of a material such as silicone, neoprene, ethylene propylene diene monomer, nitrile rubber, nitrile, polyvinyl chloride, nitrile/PVC blends, or urethanes. In some embodiments, the shell body 102 are formed of a plastic material, such as an acrylate (e.g., poly(methyl methacrylate)), silicone, neoprene, ethylene propylene diene monomer, nitrile rubber, nitrile, polyvinyl chloride, nitrile/PVC blends, or urethanes.

The crossover circuit 112 is either a passive crossover circuit or an active crossover circuit and provides input to the drivers 118, 120, 122 from an external audio source 142. In some embodiments, the crossover circuit 112 is electrically coupled to a cable socket 144 via a cable 146, and the cable socket 144 is connected to the external audio source 142 via a cable 148. Alternatively, the crossover circuit 112 may be hard-wired to the shell body 102 via the cable 146, and the shell body 102 may be coupled to the external audio source 142 via the cable 148. The external audio source 142 may include a power source (e.g., battery) and a wireless transceiver or other means for receiving user input and/or audio input from an external electronic device (e.g., mixer board, smart phone or other similar unidirectional or bidirectional audio delivery device).

In some embodiments, the cap plate 106 and/or the opening 104, which acts as the interface between the cap plate 106 and the shell body 102, are customized based on size and shape of a user's ear. The outer ear shell portion 150 can be sized and formed so that the second cavity region 132 is just large enough to receive the drivers 118, 120, 122, the crossover circuit 112, and at least a portion of the module body 128 of the driver module 110. In some cases, a depth of the second cavity region 132 is sized so that an outer edge of the cap plate 106 and the second cavity region 132 does not protrude outside or minimally protrudes outside of a user's ear. Also, in some cases, widths (e.g., direction perpendicular to the axis of the first cavity region 130, or X and Y directions) of the second cavity region 132 are sized so that a lateral outer dimension of the shell body 102 adjacent to the second cavity region 132 is minimized and/or, for example, fits within the cavum conchae and incisura intertragica regions of an user's ear. The cap plate 106 and the opening 104 may also be adjusted to form a water-tight seal that protects the driver module 110 and its supporting components from external contamination (e.g., sweat).

In some embodiments, the shell body 102 is formed using an additive manufacturing process, such as a 2.5D or 3D printing process. After the shell body 102 is customized and printed, the driver module 110 including the drivers 118, 120, 122 and the crossover circuit 112 are inserted into the cavity 108 of the printed shell body 102, such that the module body 128 of the driver module 110 is directed toward the output face 116 with sound bores 136, 138 proximal to the output face 116. After positioning the driver module 110 into the cavity 108, the cap plate 106 is then fitted over the opening 104 of the shell body 102 to create a liquid tight seal, which is formed at the cap mounting surface 109 of the cap plate 106, to protect the in-ear audio device's internal components, such as the driver module 110 components. In some embodiments, an adhesive or bonding agent (e.g., epoxy) is positioned on the cap mounting surface 109 to cause a desirable seal to be formed between the cap plate 106 and the shell body 102.

When desirably positioned, the driver module 110 is positioned within shell body 102 such that sound bores 136, 138 are flush with the end of output face 116. This arrangement allows for the repeatable and desired placement of the drivers 118, 120, and 122 and module body 128 within the shell body 102 to improve sound quality, noise isolation and to prevent feedback. After sealing the cavity 108, the electrical components of the driver module 110 are electrically connected to the external audio source 142. Alternatively, the electrical components of the driver module 110 may be electrically connected to the external audio source 142 before sealing the cavity 108 in order to more easily connect or test the effectiveness of the driver module 110. Alternatively, the electrical components of the driver module 110 may be wirelessly connected to the external audio source 142 by use of a wireless transceiver positioned on the crossover circuit 112 board.

Exchangeable Components

In some embodiments, an exchangeable component, such as an interchangeable faceplate 302 (hereafter faceplate 302), is attached to a portion of the in-ear enclosure 101, such as the cap plate 106 to improve the capability of an in-ear audio device or improve an in-ear audio device's ability to perform a desired use. The faceplate 302 may be interchanged for a functional or decorative purpose, and/or replaced when the faceplate has achieved its desired function or reached its useful life. In one embodiment, the faceplate 302 may also have control features and/or control elements 301 (e.g., play, pause, skip, mute or other device control buttons) that allow adjustments to the functioning of the in-ear audio device 100, such as the control of one or aspects of the playback of audio content received from the wired or wirelessly connected external electronic device. As shown in FIG. 3A, the faceplate 302 is on the outmost surface of the in-ear audio device 100 when the faceplate 302 is attached to the cap plate 106. The faceplate 302 can be de-attached from the cap plate 106 as shown in FIG. 3B.

As a point of reference, FIGS. 3A-3B illustrate portions of a human outer ear 20. As noted above, the in-ear audio device 100 is configured to conform to portions of a user's outer ear 20 for a snug and comfortable fit. A description of these portions of the outer ear 20 follows and is useful for understanding how the interchangeable faceplate 302 and in-ear audio device 100 are positioned within a user's outer ear 20 in subsequent portions of the disclosure provided herein. The outer ear 20 includes an ear canal 2 (FIG. 3B) leading to an ear drum (not shown). An ear lobe 1 forms a lower portion of the outer ear 20 and a helix 6 extends from the ear lobe 1 to a top portion of the outer ear 20. When in use, the inner ear portion 114 of the shell body 102 is positioned within a portion of the ear canal 2, over the cavum conchae (not shown) and typically under a portion of the crus antihelicis inferioris 14, tragus 10 and/or antitragus 12. In some embodiments, the faceplate 302 can be formed in a size and/or shape that causes a portion of the faceplate 302 to extend over an outer portion of the outer ear 20, as shown in FIG. 3A.

In some embodiments, peripheral edges 341 (FIG. 2) of the faceplate 302 are configured to substantially align with (e.g., match or mirror) the outer contours and edges of the exposed outer surface(s) of the in-ear audio device 100, such as the outer edges 106A (FIG. 2) of the cap plate 106 and/or the outer edges 102A (FIG. 2) of the shell body 102 (FIG. 2). In one example, as shown in FIG. 2, the peripheral edge 341 of the interchangeable faceplate 302 is aligned with a peripheral edge (e.g., outer edge 106A) of the cap plate 106 and the peripheral edge (e.g., outer edge 102A) of the shell body 102. In some embodiments, the peripheral edges 341 of the faceplate 302 are not configured to align with the outer edges of the exposed outer surface of the cap plate 106 or shell body 106 of the in-ear audio device 100. In one example, the faceplate 302 may be smaller than at least one or more of the outer dimensions of the exposed outer surface(s) of the in-ear audio device 100, such as the edges 106A of the cap plate 106 and/or the edges 102A of the shell body 102. In another example, as illustrated in FIG. 3A, the faceplate 302 may include at least one dimension (e.g., lower edge dimension) that is larger than the outer dimensions of the exposed outer surface(s) of the in-ear audio device 100, and thus at least a portion of the peripheral edge is not aligned with a peripheral edge of the cap plate 106 and/or the shell body 102.

In some embodiments, the underside surface 322 of the faceplate 302 has a contour that follows the contour (e.g., external shape) of an exposed outer surface of the in-ear audio device 100. In other embodiments, the underside surface 322 of the faceplate 302 has a contour that does not follows the contour of an exposed outer surface of the in-ear audio device 100.

The faceplate 302 is engaged with the cap plate 106 by use of a device engagement mechanism that allows the faceplate 302 to be detachably coupled to the cap plate 106. The device engagement mechanism includes one or more engagement mechanism features 304 that are formed on a portion of the faceplate 302 and one or more mating engagement features formed on the cap plate 106 to allow the two parts to be mechanically attached and detached from each other to allow different versions of the faceplate 302 to be positioned on the cap plate 106 at different times. The engagement features are generally configured to provide a positive engagement between a portion of the cap plate 106 and the faceplate 302 such that vibrations, gravity or the normal motion of the user will not be able to cause the faceplate 302 to become disengaged from the in-ear audio device 100. The positive engagement created between a portion of the cap plate 106 and the faceplate 302, which is due to a contact force created by the physical contact between the one or more engagement mechanism features 304 and one or more mating engagement features formed on the cap plate 106, generally require a user to apply an amount of force or torque to the faceplate 302 to cause the faceplate 302 to become engaged with and disengaged from the in-ear audio device 100. In some embodiments, engagement features of the cap plate 106 and faceplate 302 are configured to be engaged and disengaged from each other one or more times, and preferably at least two or more times. In some embodiments, the device engagement feature will not include or utilize magnetic field generating elements to form the mechanical attachment between the cap plate 106 and the faceplate 302 to prevent the undesirable interference that can be created between the magnetic fields generated from the device engagement feature components and the magnetic field inducing elements found in the one or more drivers 118, 120, or 122 positioned within the second cavity region 132.

In some embodiments, the device engagement mechanism, which can be a bayonet-type coupling, is a mechanical locking mechanism that can be actuated by twisting of the faceplate 302 relative to the cap plate 106, and is also referred to herein as a "twist-lock mechanism." This twist-lock mechanism does not require large volume of material as in a conventional insertion-type coupling, and thus can be miniaturized as a component of an in-ear audio device. The twist-lock mechanism also does not require any elements that may interfere with sound quality of an in-ear audio device, such as magnets in a magnetic coupling, and thus can be employed without scarifying comfort and sound quality of a custom in-ear audio device. Moreover, it is believed that the use of magnetic elements alone to retain the faceplate 302 on the in-ear audio device 100 cannot provide the required amount of positive engagement to reliably retain the faceplate 302 on the in-ear audio device 100 during normal active use by a user and/or when decorative elements 1060 (FIG. 10D) are position on a faceplate 302, without seriously affecting the normal functioning of the in-ear audio device 100. Thus, the use of the physical engagement configurations described herein provide a significant advantage over these more conventional magnetic coupling designs. In one example, as shown in FIGS. 3A-3B, and 9A-9D, the faceplate 302 is able to be engaged with the cap plate 106 by use of a device engagement mechanism that includes an attachment ring 320, which is coupled to a portion of the faceplate 302. Thus, when in use (FIG. 3A), the attachment ring 320 (FIGS. 4, 7 and 8) is engaged with an engagement mechanism feature 304 (hereafter engagement feature 304) that is formed within a mounting region 305 of the cap plate 106 (FIGS. 3B and 4) of the in-ear enclosure 101, to allow the faceplate 302 to be supported by and retained by the in-ear enclosure 101 of the in-ear audio device 100. While the disclosure provided herein describes the mounting region 305 and engagement feature 304 being positioned on the cap plate 106 this configuration is not intended to be limiting as to scope of the disclosure provided herein, since the mounting region 305 and engagement feature 304 may alternately be formed on another part of the in-ear enclosure 101 (e.g., shell body 102).

Figure 4:
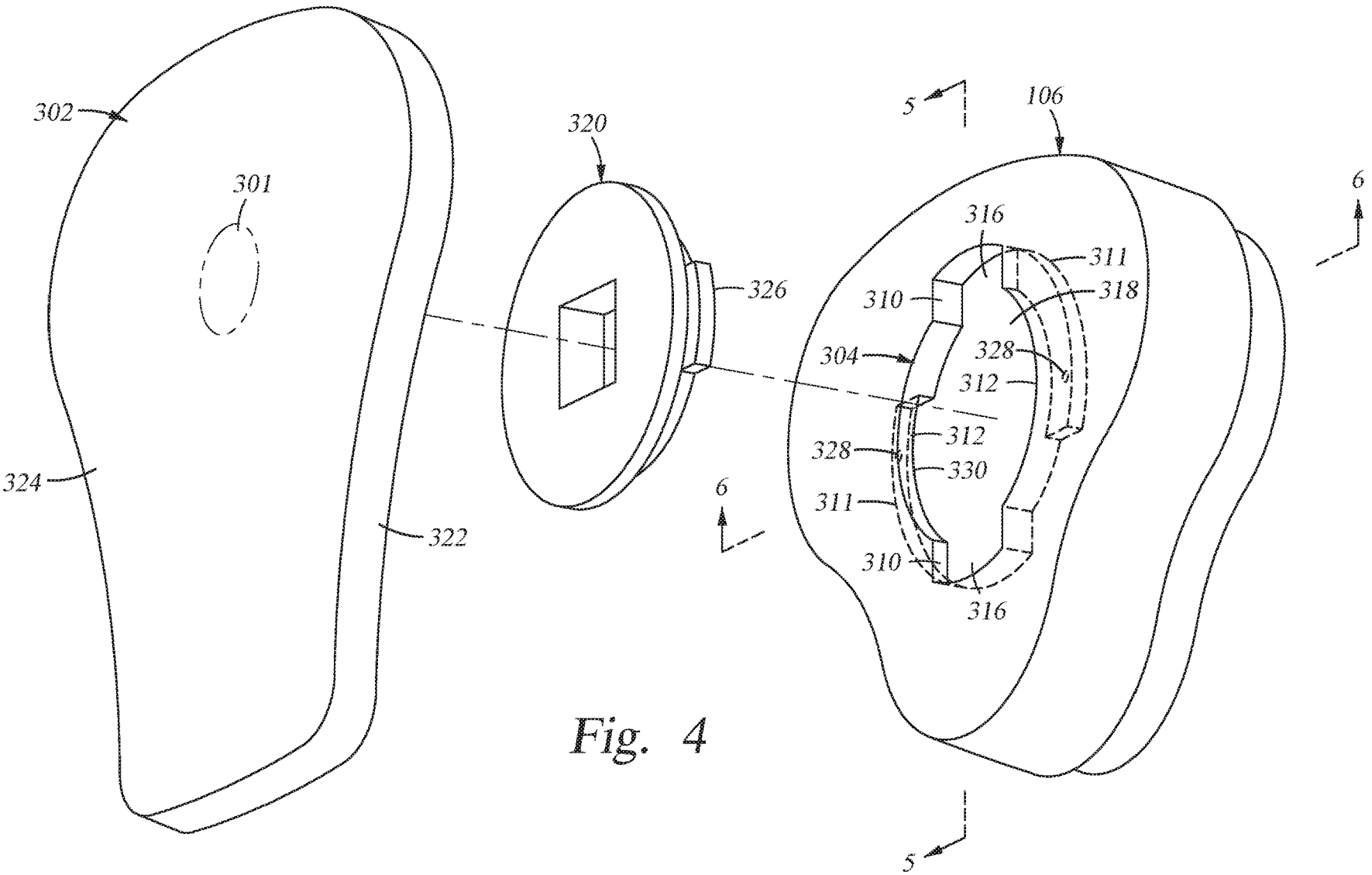
FIG. 4 is a schematic view of a faceplate and a cap plate according to one embodiment.
Figure 8:
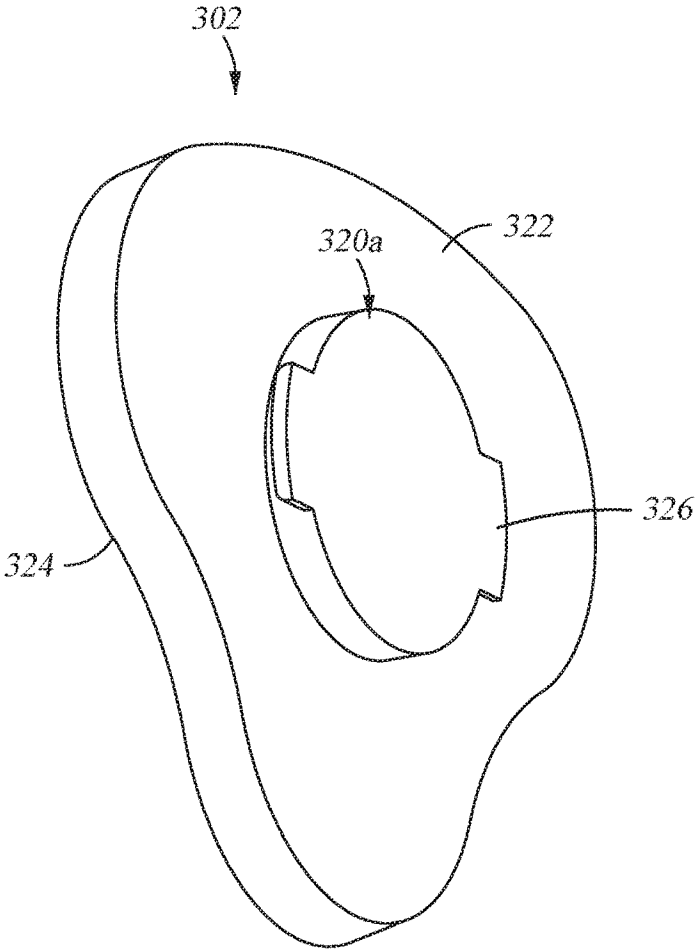
FIG. 8 is a schematic view of an underside surface of an assembled version of the faceplate illustrated in FIG. 7 or a single-piece faceplate, according to one or more embodiments.
Figure 7:
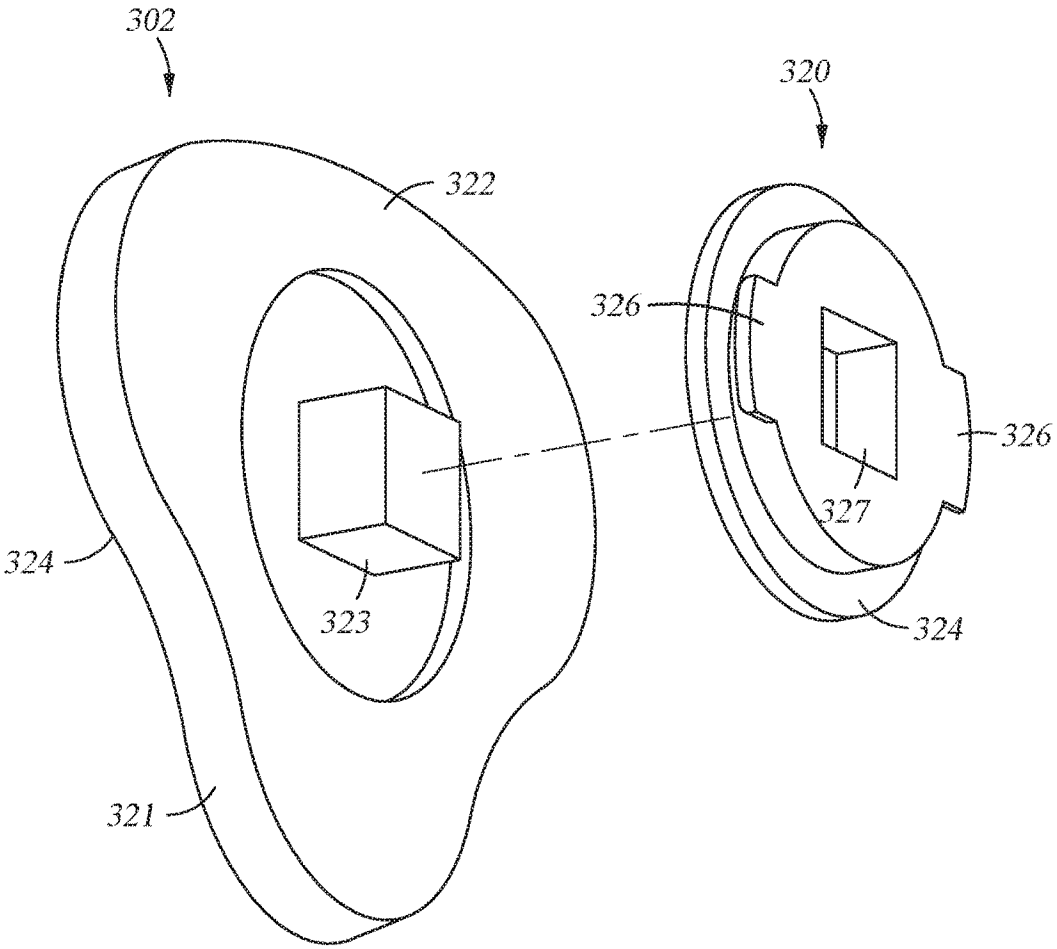
FIG. 7 is an exploded schematic view of an underside surface a faceplate according to one embodiment.

FIG. 4 is a schematic exploded isometric view of the faceplate 302 having an underside surface 322 and an exterior surface 324 and the cap plate 106 having a front surface 306 and a back surface 308 according to one embodiment. FIG. 7 is a schematic exploded isometric view of the underside surface 322 of the faceplate 302 according to one embodiment. FIG. 8 is a schematic view of an underside surface of an assembled version of the faceplate illustrated in FIG. 7 or a single-piece faceplate, according to one or more embodiments. In one embodiment, the attachment ring 320 may be separable from the main portion 321 of the faceplate 302. The main portion 321 is also referred to herein as the "body", or "body portion," of the faceplate 302. In one configuration, a mounting feature 323 (FIG. 7) formed on the faceplate 302 is adapted to receive and retain the attachment ring 320 by use of a mating feature 327. In another embodiment, an attachment ring 320*a* is formed as an integral part of the faceplate 302, or also referred to herein as a single-piece faceplate 302. FIG. 8 illustrates a schematic view of an underside surface of an inseparable version of the attachment ring and faceplate illustrated in FIG. 7, or alternately a single-piece faceplate 302.

The cap plate 106 shown in FIGS. 3B and 4 is plate shaped and includes the engagement feature 304 formed within the mounting region 305 (FIG. 3B) on the front surface 306 of the cap plate 106 of the in-ear enclosure 101. The engagement feature 304 includes one or more notches 310 and one or more engagement regions 311 which are configured to receive and positively engage with mating engagement features of the faceplate 302, such as portions of the attachment ring 320 (e.g., bayonet tabs 326 (FIGS. 4 and 7)) which will be discussed further below. In some embodiments, the one or more engagement regions 311 include one or more ridge regions 312 that are position adjacent to a notch 310. Underneath each of the ridge regions 312, a slot 314 (FIGS. 5 and 6) is formed such that a bottom surface 316 of the adjacent notch 310 is continuous with a bottom surface 318 of the slot 314. The contours of the slot 314 and attachment ring 320 are configured and/or shaped to generate a contact force between a surface of the slot 314 and portions of the attachment ring 320 to form the positive engagement when the attachment ring 320 is positioned within the slot 314. While the device engagement mechanism disclosed herein primarily discusses a rotational engagement configuration, in some alternate embodiments, the device engagement mechanism may include a linear configuration in which the attachment ring 320 (FIGS. 4 7, and 8) is positively engaged with an engagement feature 304 that extends in a first direction. In this configuration, the attachment ring 320 can be configured to slide into a linear slot of an engagement feature 304 that is oriented in the first direction (e.g., substantially downward in a vertical direction). The linear oriented engagement feature 304 will include a notch and an engagement region that are configured to generate a contact force between the surface of the formed slot and portions of the attachment ring 320.

In some embodiments, the engagement feature 304 is formed in an exterior region, which is adjacent to the front surface 306 of the cap plate 106, such that a fluid cannot pass through the opening of the engagement feature 304 at the front surface 306 and enter the cavity 108 due to a wall portion 314*a* of the cap plate 106, which is positioned between the bottom surface 318 and the back surface 308 of the cap plate 106. In some embodiments, the wall portion 314*a* comprises a plastic sheet (e.g., Mylar sheet) that is sealably bonded to or formed with a substantially more rigid outer portion of the cap plate 106, which is configured to contact the shell body 102. Thus, the cavity 108 is not in fluid communication with the engagement feature 304.

However, in some alternate embodiments, the attachment ring 320 is configured to form a fluid impermeable seal with a portion of an alternately configured engagement feature (not shown), which in the absence of the faceplate 302 is in communication with the cavity 108, when the faceplate 302 is positioned on the in-ear audio device 100. In one example, the alternately configured engagement feature includes a through hole that is in fluid communication with the cavity 108 at one end and the external environment that surrounds the external surfaces (e.g., outer surface of the cap plate 106) of the in-ear audio device 100 at the other end. In this example, the through hole includes a portion that has first diameter that is sized to form a fluid impermeable seal with an outer diameter of a portion of the attachment ring 302 (e.g., portion between the bayonet tabs 326 and surface 322 of the faceplate 302) when the faceplate 302 is positively engaged with the engagement feature 304 of the in-ear audio device 100. In this case, the first diameter may be equal to or slightly smaller (e.g., 0.02 mm to 0.20 mm less) than the outer diameter of a portion of the attachment ring 302 so as to allow a seal to be formed and/or the alternately configured engagement feature may include a compliant seal that is configured to interface with a portion of the faceplate 302 to form a seal. Thus, in this case, the cavity 108 is not in fluid communication with the outer portion of engagement feature 304 when the faceplate 302 is positively engaged with the in-ear audio device 100. In some embodiments, the engagement feature 304 further comprises a through hole that is in fluid communication with the cavity 108, and a portion of the through hole is configured to engage with a portion of the mating engagement feature (e.g., attachment ring 320) of the interchangeable faceplate 302 to form a fluid impermeable seal.

The exterior surface 324 of the faceplate 302 is the outermost surface of the in-ear audio device 100 when assembled. The faceplate 302 further includes an attachment ring 320 on the underside surface 322 of the faceplate 302. The attachment ring 320 includes outwardly extending bayonet tabs 326 arranged to interlock with and positively engage with a locking element 328 (FIGS. 5, 6 and 9A) of the ridge regions 312 of the cap plate 106. The bayonet tabs 326 may be formed of a solid material, such as a metal, plastic or composite material, and be glued to or formed on the underside surface 322 of the faceplate 302. In some configurations, the faceplate 302 is flat-plate shaped such that there is substantially no gap or a small gap between the faceplate 302 and the cap plate 106 when they are brought together and interlocked. The bayonet tabs 326 may have a thickness of between 1 mm and about 3 mm as measured in a direction parallel to a central axis of the attachment ring 320 (i.e., dashed center line in FIGS. 4 and 7). The bayonet tabs 326 may have a width of between about 3 mm and 5 mm as measured parallel to the underside surface 322 and perpendicular to a radius extending from the central axis of the attachment ring 320. The bayonet tabs 326 may also have a length of between about 2 mm and the width of an inner part of the outer ear (e.g., cavum conchae), such as between 2 mm and 20 mm as measured from tip-to-tip of the bayonet tabs 626 along a line that is parallel to the underside surface 322. The attachment ring 320 may have a thickness of between 1.5 mm and about 10 mm, such as between 2 mm and about 6 mm, as measured from the underside surface 322 to the tip of the outer most surface of the attachment feature in a direction parallel to a central axis of the attachment ring 320.

Figure 5:
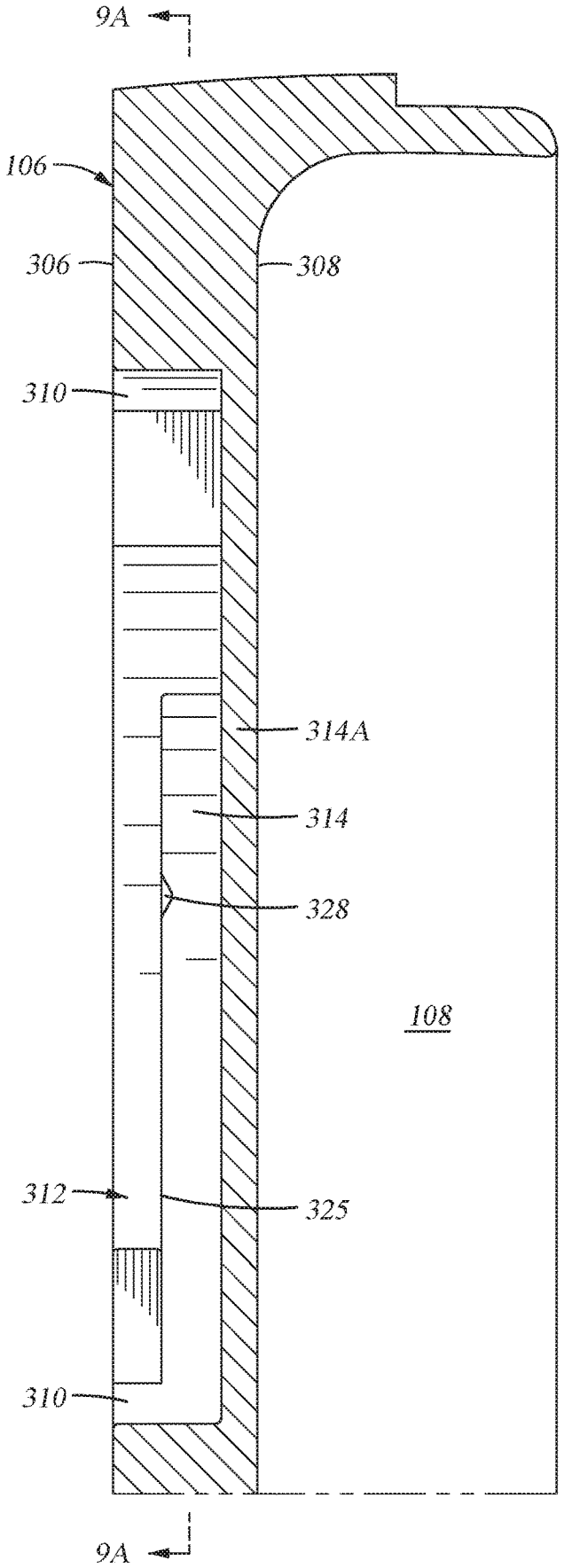
FIG. 5 is a partial cross-sectional view of a cap plate according to one embodiment.
Figure 6:
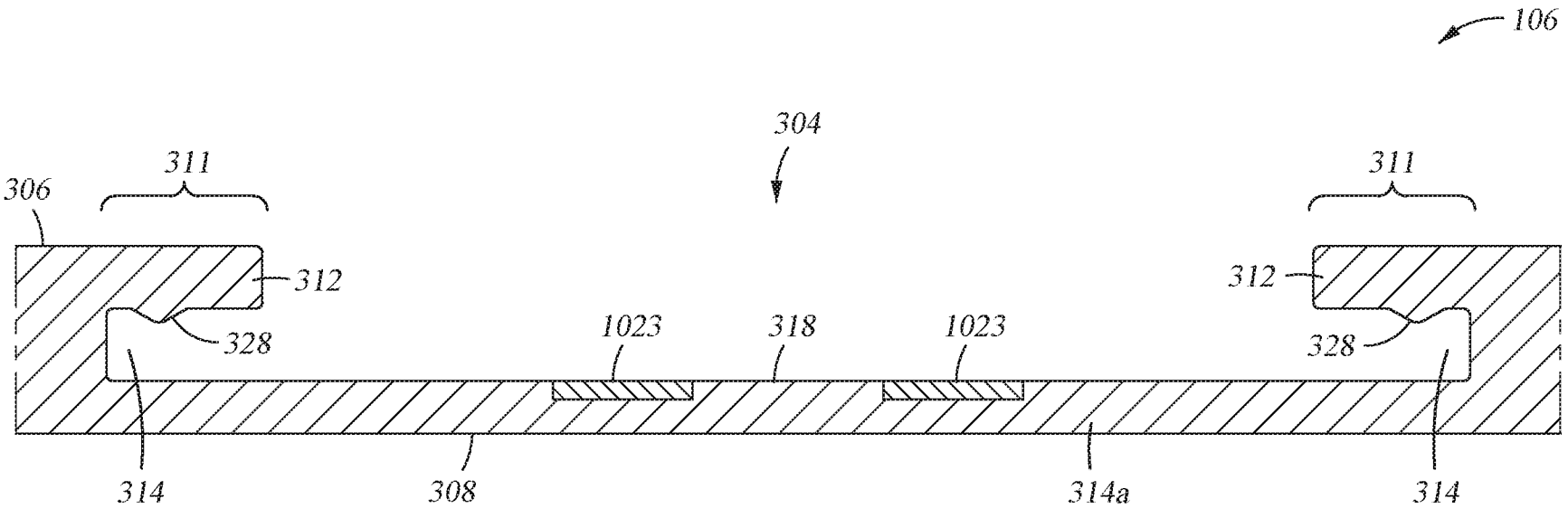
FIG. 6 is a cross-sectional view of a cap plate according to one embodiment.

FIG. 5 is a partial cross-sectional view of the cap plate 106 cut along a sectioning line 5-5 shown in FIG. 4. FIG. 6 is a cross-sectional view of the cap plate 106 formed by the sectioning line 6-6 shown in FIG. 4, and for clarity purposes only contains features sectioned by the cutting plane defined by the sectioning line.

During an attachment process, the faceplate 302 is caused to engage with the cap plate 106 by placing the underside surface 322 of the faceplate 302 on the front surface 306 of the cap plate 106 such that the bayonet tabs 326 are aligned with the respective notches 310. Then, the faceplate 302 rotated in a clockwise direction by a desired angle, which can, for example, vary from about 45 degrees to multiple full rotations, or until the bayonet tabs 326 are locked in a desired position within the respective slots 314. In one embodiment, the faceplate 302 rotated in a clockwise direction an angle that is less than or equal to 360 degrees, or even less than 180 degrees, such as an angle between 45° and 135°, for example, about 90°, such that the bayonet tabs 326 is locked in the respective slots 314. In yet another embodiment, as illustrated in FIG. 9E, the faceplate 302 can be rotated in a clockwise direction a desired angle, such as at least 360 degrees and less than or equal to 1080 degrees, such that the bayonet tabs 326 follow a slot 314 that is formed in a helical or spiral shape about the central axis (i.e., dashed center line in FIGS. 4 and 7). The helical shape of the slot 314 can allow the spacing of the faceplate 302 to the mounting region 305 to be adjusted by adjusting the number of turns the faceplate 302 is rotated in the attachment process. An example of a process of engaging the bayonet tabs 326 of the attachment ring 320 of the faceplate 302 with the portions of the engagement feature 304 is discussed further below in relation to FIGS. 9A-9D. The process of locking the faceplate 302 within the engagement regions 311 of the engagement feature 304 is caused by a varying height or gap formed between the lower edge of the locking element 328 of the ridge region 312, which is formed on the upper edge of the slot 314, and the bottom surface 325. However, the contours of the ridge region 312 can be additionally or alternately used to help provide positive engagement between the faceplate 302 and the engagement feature 304. In some embodiments, the gap between the lower edge of the ridge region 312 and the bottom surface 325 decreases in height as the bayonet tabs 326 traverses a circumferential path formed as they are rotated from an inserted position (e.g., left edge of the opening in FIG. 5) to a locked position (e.g., middle portion of the opening in FIG. 5) under the locking element 328 within the engagement feature 304.

Figure 9A:
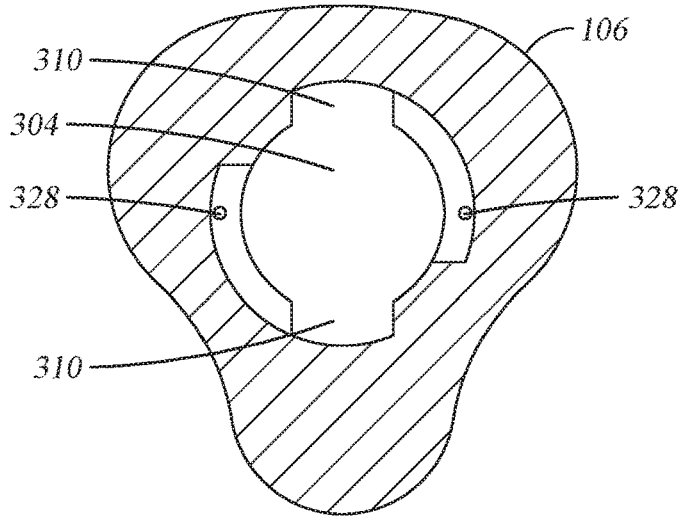
FIG. 9A is a cross-sectional view of an outer portion of a cap plate according to one embodiment.
Figure 9B:
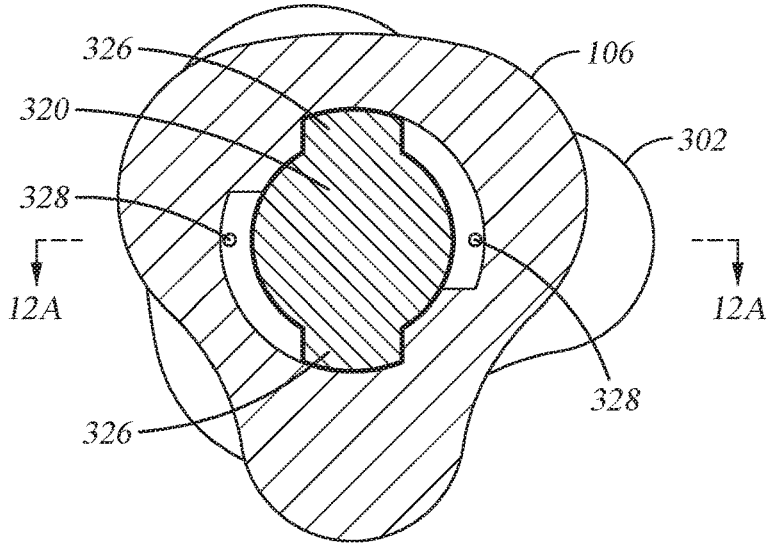
FIG. 9B is a cross-sectional view of the outer portion of a cap plate and a portion of an attachment ring which is inserted with a portion of the engagement feature formed in the cap plate, according to one embodiment.
Figure 9C:
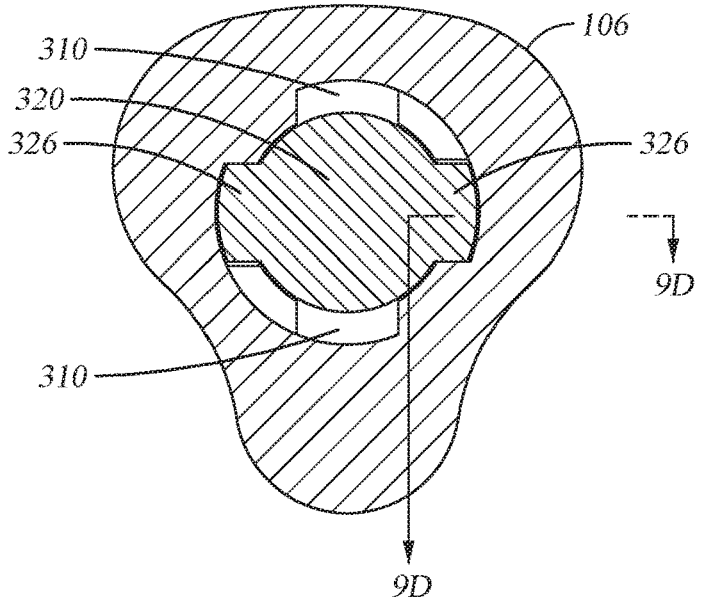
FIG. 9C is a cross-sectional view of the outer portion of the cap plate and the portion of the attachment ring, illustrated in FIG. 9B, with the portion of the attachment ring being rotated a desired angle relative to a central axis of the engagement feature, according to one embodiment.

An example of a process of causing the bayonet tabs 326 of the attachment ring 320 of the faceplate 302 to engage with the portions of the engagement feature 304, so as to become coupled together or "locked" is shown in FIGS. 9A-9C. FIG. 9A is a cross-sectional view of an outer portion of a cap plate 106, which is formed using a cutting plane 9A-9A in FIG. 5. In the first step of the process, as shown in FIG. 9B, a portion of an attachment ring 320 is inserted within a portion of the engagement feature 304 formed in the cap plate 106.

During the first process step, the bayonet tabs 326 are aligned with the respective notches 310, and then the faceplate 302 and the cap plate 106 are brought together so that the bayonet tabs 326 are able to be positioned within their respective notches 310.

In the second step, as shown in FIG. 9C, the attachment ring 320 and faceplate 302 are rotated by a user a desired angle relative to a central axis (e.g., normal to page of the FIG. 9B or 9C) of the engagement feature 304 or until the bayonet tabs 326 of the attachment ring 320 are aligned with the locking elements 328. As the faceplate 302 is rotated in the clockwise direction, for example, the bayonet tab 326 is moved through the slot 314. As the bayonet tab 326 rotates along the bottom surface 325 (FIG. 5) and over the locking element 328 (FIGS. 6 and 9D), the faceplate 302 is brought closer to the cap plate 106. Similarly, the faceplate 302 can be disengaged by rotating the faceplate 302 by an desired angle, such as about 90°, in the counterclockwise direction. Therefore, the lower edge of the ridge region 312 (that is, the upper edge of the slot 314) forms a track that can be used to control the movement of the bayonet tab 326 relative to the cap plate 106 and capture and retain the faceplate 302.

Figure 9D:
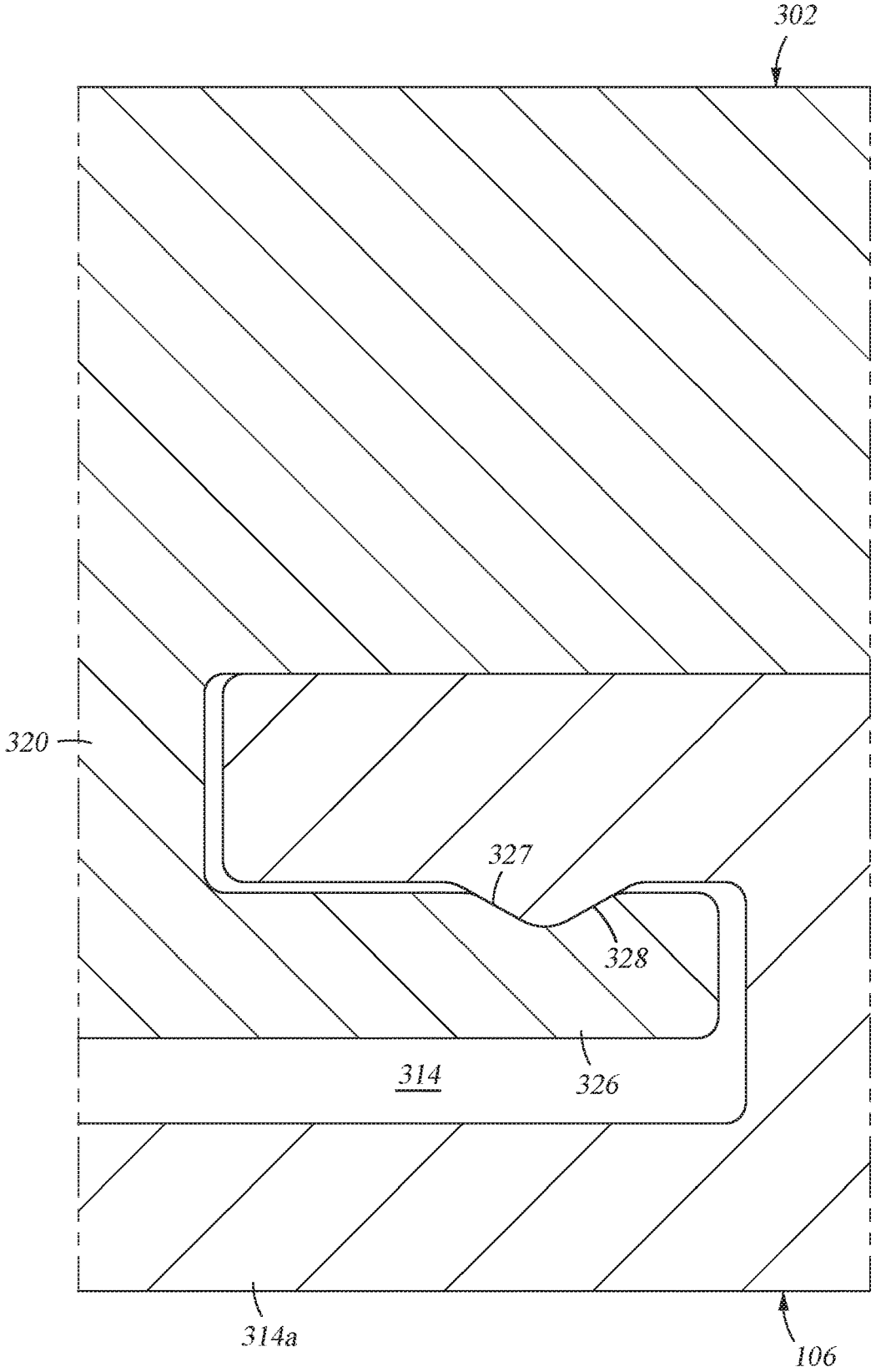
FIG. 9D is a side cross-sectional view of a portion of the cap plate and the portion of the attachment ring illustrated in FIG. 9C, according to one embodiment.
Figure 9E:
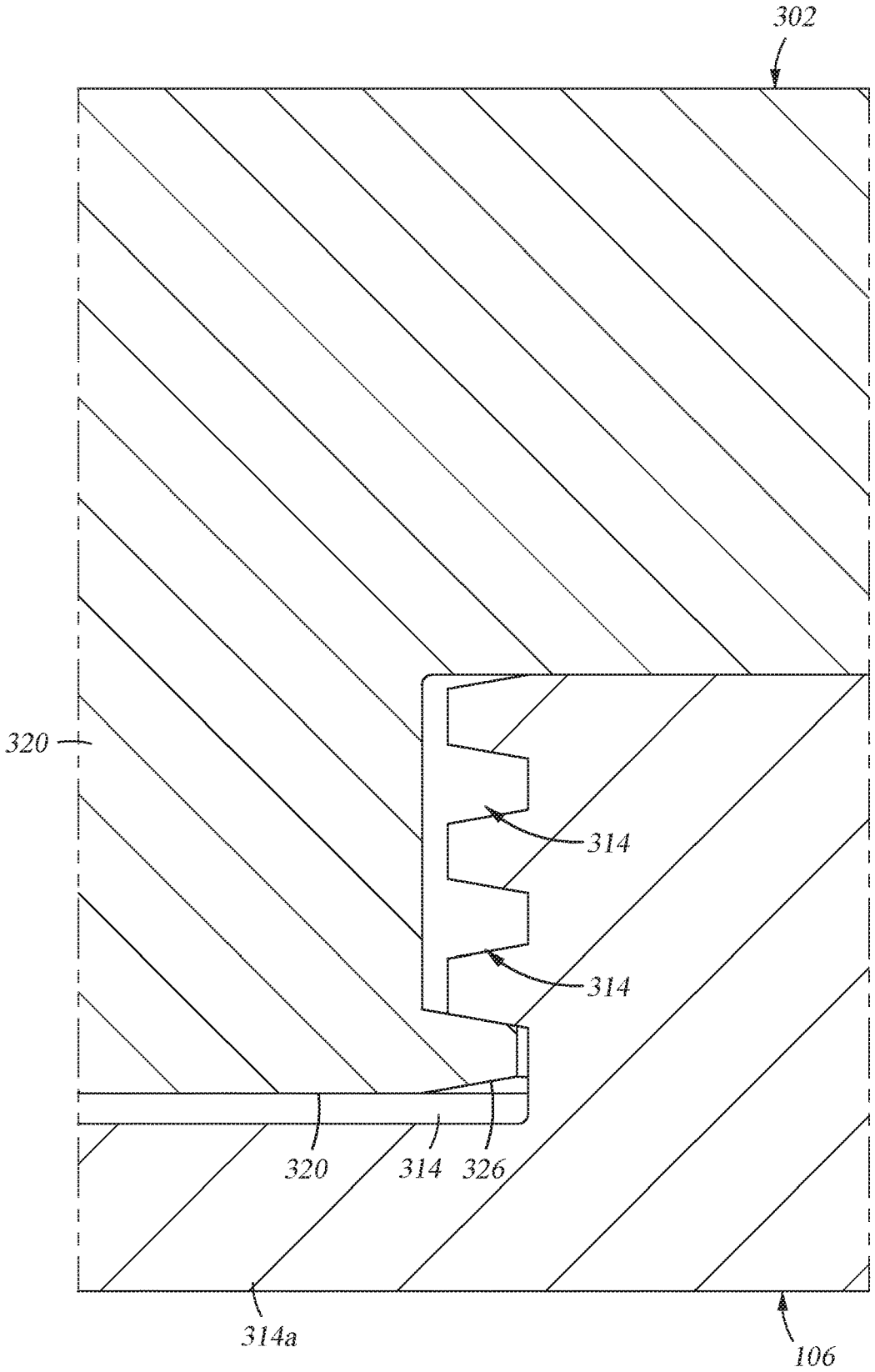
FIG. 9E is a side cross-sectional view of a portion of the cap plate that includes a helical shaped slot that includes a portion of an attachment ring disposed therein, according to one embodiment.

FIG. 9D is a side cross-sectional view of a portion of the cap plate 106 and the portion of the attachment ring illustrated in FIG. 9C, which illustrates a typical engagement between a bayonet tab 326 and a locking element 328 to allows the two parts to become coupled together or "locked". In some embodiments, a mating feature, (e.g., a recess) 327 formed in the bayonet tab 326 is configured to receive the locking element 328, and thus is used to positively engage with and substantially retain the faceplate 302 within the slot 314 and on the cap plate 106.

In the various configuration examples described herein, the engagement feature 304 includes two ridge regions 312 and the attachment ring 320 includes two bayonet tabs 326 that interlock with the two ridge regions 312. However, the number of the ridge regions 312 and the number of the bayonet tabs 326 that interlock with the ridge regions 312 may be any other numbers, such as three or four. It should also be noted that the rotational direction or other movement used to lock or unlock the attachment ring 320 from the slot 314 can be reversed from those described herein in some configurations.

The cap plate 106 may be made of acrylate, or other synthetic polymer material, such as polymethyl methacrylate (PMMA). In some embodiments, the cap plate 106 is formed of an acrylic sheet cut into an appropriate size and shape with the engagement feature 304, the notches 310, and the ridge regions 312 formed by laser cutting, injection molding, 3D printing process or other similar manufacturing process. The central region of the cap plate 106, in which the engagement feature 304 resides, may be between about 3 mm and about 15 mm in thickness, as measured in the Z-direction shown in FIG. 1. The engagement feature 304 may be between 2 mm and the width of the inner part of the outer ear, such as between about 2 mm and about 21 mm in diameter. The width of the notches 310 along the circumference of the engagement feature 304 may be between about 1 mm and 4 mm, or just enough to provide clearance for the bayonet tabs 326. The width of the ridge region 312 along the circumference of the engagement feature 304 may be between about 0.5 mm and 2 mm. The height of or gap formed within the slots 314, as measured from the bottom surface 318, may be between about 0.5 mm and about 1 mm.

The faceplate 302 may include one or more solid materials, such as a metal, plastic or composite material, that are bonded or attached together. In some embodiments, the faceplate 302 may be made of a plastic material and/or polymeric material. In some embodiments, the faceplate 302 may be made of an acrylate, or synthetic polymer material, such as polymethyl methacrylate (PMMA), polycarbonate, nylon or other useful materials. In some embodiments, the faceplate 302 is formed from a sheet of material by laser cutting, formed by an injection molding process, formed by a 3D printing process or other similar manufacturing process. The body 321 of the faceplate 302 at its thickest point may be between about 3 mm and about 15 mm in thickness, as measured from the underside surface 322 to the exterior surface 324. The outer diameter of the attachment ring 320 will generally be smaller than the outer diameter of the engagement feature 304. The attachment ring 320 may be formed from the same materials as the faceplate 302. However, in some configurations, the attachment ring 320 portion of the faceplate 302 is formed from a material that has a hardness or yield strength that is greater than the rest of the material that the faceplate 302 is formed from, so that the bayonet tab 326 portions of the attachment ring 320 will not have significant wear when the process of locking the faceplate 302 to the cap plate 106 is performed multiple times.

Figure 10B:
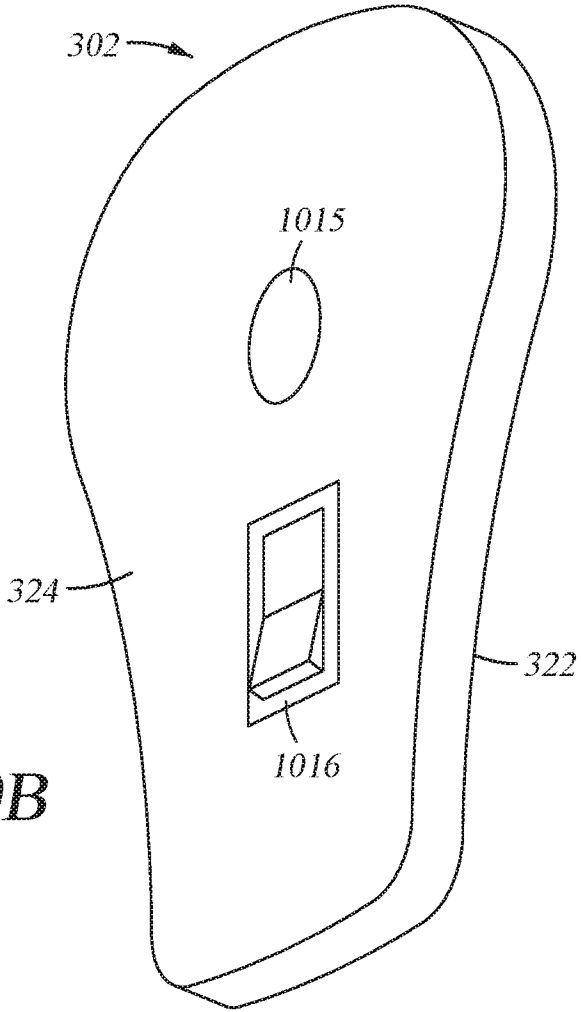
FIG. 10B is a schematic view of an exterior surface a faceplate that includes one or more functional features and/or decorative elements, which can be used with any of the embodiments of the disclosure provided herein.
Figure 10A:
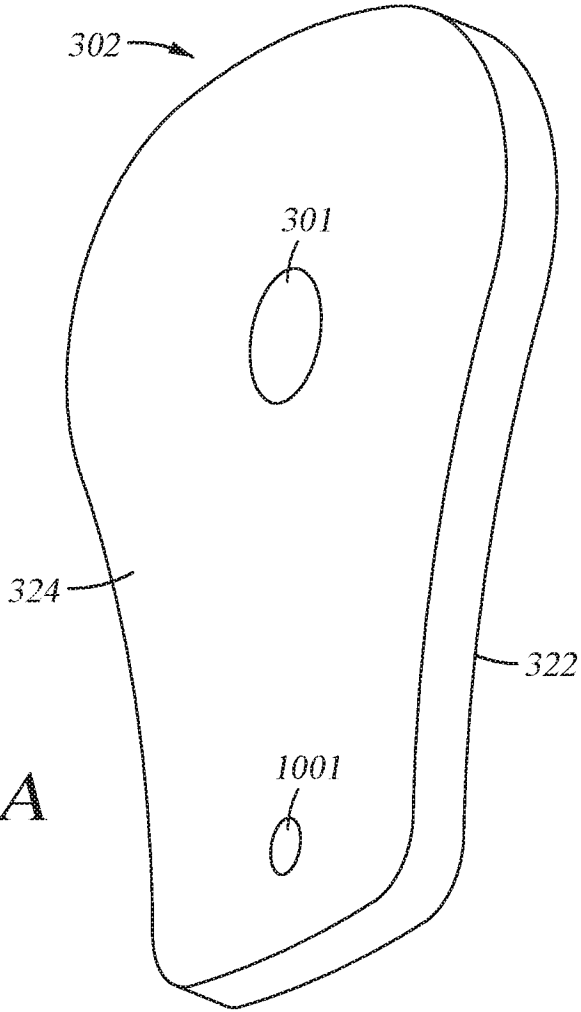
FIG. 10A is a schematic view of an exterior surface a faceplate that includes one or more functional features and/or decorative elements, which can be used with any of the embodiments of the disclosure provided herein.
Figure 10D:
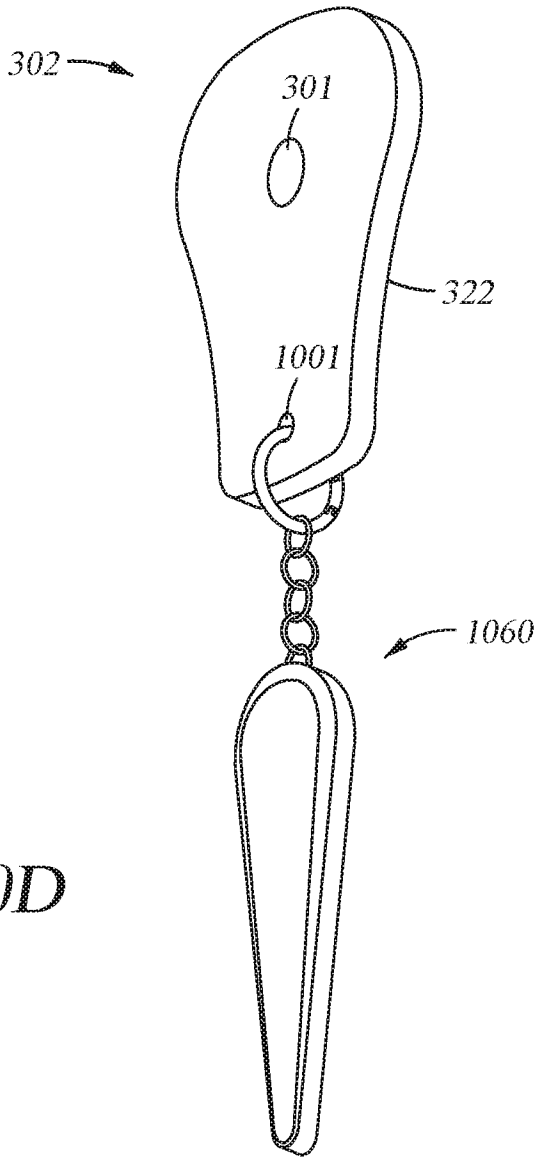
FIG. 10D is a schematic view of an exterior surface a faceplate that includes one or more decorative elements attached to the faceplate illustrated in FIG. 10A, which can be used with any of the embodiments of the disclosure provided herein.

In some embodiments, the faceplate 302 includes one or more ornamental and/or colorful designs etched, printed, scribed, painted and/or affixed to the front surface 306. In some configurations, one or more surfaces of the faceplate 302 include a coating or deposited layer for decorative or utilitarian purposes. In some embodiments, as illustrated in FIG. 10A, the faceplate 302 may include one or more attachment features 1001 (e.g., hole, slot or protruding feature) that are configured to receive and support various types of adornments, such as jewelry, earrings, gems or other ornamental elements. FIG. 10D illustrates an example of a faceplate 302 that includes one or more decorative elements 1060 (e.g., decorative rings) that are attached to the attachment features 1001. The adornments can have a mass that will not cause the in-ear audio to be dislodged from the users ear during normal activities. In one example, an adornment may have a mass of 1 gram to about 40 grams.

Figure 10C:
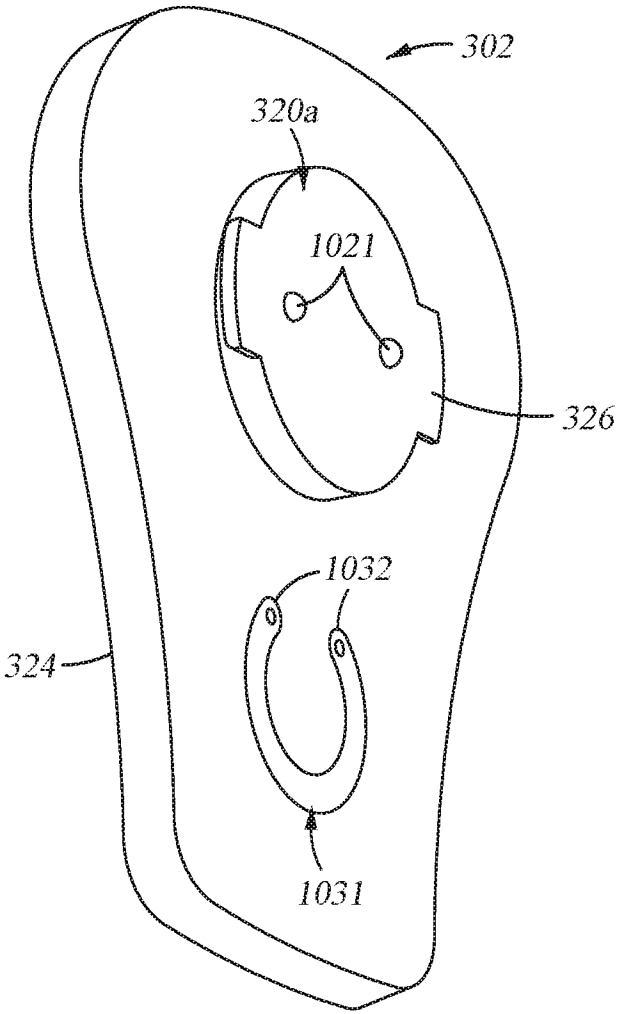
FIG. 10C is a schematic view of an underside surface of a faceplate that includes one or more functional features and/or decorative elements, which can be used with any of the embodiments of the disclosure provided herein.

In some embodiments, the faceplate 302 includes one or more electrical components, such as a printed circuit board that includes a plurality of electric components formed thereon. FIGS. 10A-10C illustrate various examples of faceplates that include various electrical elements that may be formed within or positioned on a faceplate to provide and/or enable some desired and useful function of the in-ear audio device 100. In one example, as illustrated in FIGS. 3A-3B and 10A, the faceplate 302 includes one or more control elements 301 that allow adjustments to be made to the functioning of the in-ear audio device 100. In some embodiments, faceplates 302 having differently functioning control elements can be formed so that different device functions can be performed by the in-ear audio device 100 just by replacing faceplates that contain electrical components that are configured to perform different functions. For example, at a first time a first faceplate $\mathbf{302}_1$ (not shown) that is attached to the in-ear audio device 100 can include a button 1010 (FIG. 1) and supporting electrical hardware that will cause the in-ear audio device 100 to play, pause, skip, or mute audio that is being delivered to a user, by use of the drivers 118, 120 122, due to the user pressing the button 1010 of the first faceplate $\mathbf{302}_1$ one or more times. Then, at a second time a second faceplate $\mathbf{302}_2$ (not shown) that is attached to the in-ear audio device 100 can include a button 1010 and supporting electrical hardware that will cause the in-ear audio device 100 to initiate wireless communication between the in-ear audio device 100 and an external electronic device due to the user pressing the button 1010 of the second faceplate $\mathbf{302}_2$ one or more times. In some embodiments, one or more of the electrical components found within the faceplate 302 are configured to send a signal to or receive a control signal from an electrical component found within the in-ear audio device 100. For example, in the first example discussed above, the pressing of the button 1010 will cause a signal to be sent to one or more electrical components within the in-ear audio device 100 that cause the audio that is being played to be paused, skipped, or muted. In other embodiments, one or more of the electrical components found within the faceplate 302 are configured to send a signal to or receive a signal from an external electrical device by use of a wireless or wired communication method. In one example, an antenna formed on the faceplate 302 is configured to wireless send a signal via a Bluetooth or WiFi that is then used by an external electronic device to perform some useful task (e.g., initiate pairing) or receive a signal via a Bluetooth or WiFi that is then used by the in-ear audio device 100 to perform some useful task (e.g., start streaming audio to the user).

In some configurations, as illustrated in FIG. 10B, a faceplate 302 includes one or more multifunction buttons 1016 that allow different activities to be performed by the user's interaction with the multifunctioning buttons.

In another example, as illustrated in FIG. 10B, a faceplate 302 includes one or more sensors 1015 that allow components within the in-ear audio device 100 to sense a desired physical property useful for the in-ear audio device 100, such as a capacitive touch senor that is used to detect a user's interaction, an optical detector to detect wavelengths of light emitted from an electromagnetic radiation source, hall sensors to detect the presence of external or internal magnetic fields or other useful sensors. In one embodiment, the faceplate 302 includes a microphone that is configured to detect ambient sound and provide an audio signal to the electronic components in the in-ear audio device 100 or are in electrical communication with the in-ear audio device 100. In one configuration, the microphone is an embedded microphone that does not substantially extend from the outer of the faceplate 302, and thus avoids the moment or torque applied to the in-ear audio device 100 provided by a mass that is extended from the faceplate 302, such as a boom microphone common in head phones.

In one embodiment of the faceplate 302, as illustrated in FIG. 10C, one or more electrical contacts 1021 formed on a surface of the faceplate 302, such as the lower surface of the attachment ring 320*a*, are configured to contact mating electrical contacts 1023 (FIG. 6) formed on a surface of the cap plate 106. In one example, the mating electrical contacts formed on a surface of the cap plate 106 are electrical contacts 1023 formed on the bottom surface 318 of the engagement feature 304. In this configuration, the electrical contacts 1021 formed on a surface of the faceplate 302 can be in contact with the electrical contacts 1023 formed on the bottom surface 318 of the engagement feature 304 when the faceplate 302 is engaged with the cap plate 106. In one example, the electrical contacts 1021 are separable, multiuse electrical contacts, such as pogo pins. The one or more electrical contacts 1021 can be coupled to one or more of the electrical components formed on or within the faceplate 302. In one example, the one or more electrical contacts 1021 are electrically connected to one or more of the control elements 301 to allow a signal provided from the one or more control elements 301 to be delivered to an electrical component within the in-ear audio device 100 through the electrical contacts 1023 formed on the bottom surface 318 of the engagement feature 304. In this example, the electrical contacts 1023 formed on the bottom surface 318 of the engagement feature 304 can be connected to electrical components within the cavity 108 (e.g., crossover circuit 112, wireless transceiver components) by use of sealed connectors or conductive vias (not shown) that sealably extend through the wall portion 314*a*.

In some embodiments, as illustrated in FIG. 10C, the faceplate 302 includes an antenna 1031 (e.g., loop antenna, F-type antenna) and supporting electronics (e.g., wireless transceiver, memory, processor) formed on or within a portion of the faceplate 302 to enable NFC, Bluetooth classic, BTLE, WiFi, LTE or other wireless communication techniques between components within the in-ear audio device and/or an external electronic device (e.g., smart phone, laptop, mixer boards). Generally, suitable wireless communications techniques can include at least one communication technique within the Wireless Wide Area Network (WWAN), Wireless Local Area Network (WLAN), Wireless Personal Area Network (WPAN) and/or Wireless Sensor Actor Networks (WSAN) protocols. As illustrated in FIG. 10C, the antenna 1031 can include an antenna structure that has end connections 1032 that are connected to a transceiver circuit (not show) to send or receive a wireless signal. In one example, the antenna 1031 is configured to receive and/or transmit data to an external electronic device by use of NFC communication methods.

In the example embodiments described above, a simple mechanical engagement mechanism that locks an interchangeable faceplate on a shell body of an in-ear audio device has been described herein. The engagement mechanism does not require large volume of material or any elements that may interfere with sound quality of an in-ear audio device, such as magnets in a magnetic coupling, and thus can be employed without scarifying comfort and sound quality of a custom in-ear audio device. The engagement mechanism is light in weight and can be miniaturized as components of an in-ear audio device becomes small.

While the foregoing is directed to embodiments of the present disclosure, other and further embodiments of the disclosure may be devised without departing from the basic scope thereof, and the scope thereof is determined by the claims that follow.

What is claimed is:

1. An in-ear audio device, comprising:

a driver module disposed within an in-ear enclosure, wherein the driver module is configured to deliver audible output provided from the driver module to an output end of the in-ear enclosure; and a mounting region of the in-ear enclosure, comprising:

a device engagement mechanism comprising a rotationally symmetric engagement feature that is formed on a surface of the in-ear enclosure, wherein the rotationally symmetric engagement feature includes notches, ridge regions and a slot formed underneath each of the ridge regions, and at least a portion of the rotationally symmetric engagement feature is configured to engage with a portion of an interchangeable faceplate to cause the interchangeable faceplate to be coupled to the rotationally symmetric engagement feature, wherein the portion of the interchangeable faceplate is configured to engage with the rotationally symmetric engagement feature by positioning the portion of the interchangeable faceplate within the notch and then rotating the portion of the interchangeable faceplate to a position within the slot.

2. The in-ear audio device of claim 1, wherein the driver module is disposed within a cavity region which is defined by the in-ear enclosure, and the cavity region is not in fluid communication with the engagement feature.

3. The in-ear audio device of claim 2, wherein the in-ear enclosure further comprises:

a cap plate that has a front surface and a back surface opposite to the front surface, wherein the back surface defines a portion of the cavity region when the cap plate is positioned against a cap mounting surface of the in-ear enclosure.

4. The in-ear audio device of claim 3, wherein the cap mounting surface of the in-ear enclosure is sealably bonded to a surface of the cap plate to form a fluid tight seal.

5. The in-ear audio device of claim 1, wherein the driver module is disposed within a cavity region which is defined by the in-ear enclosure, and the engagement feature further comprises a through hole that is in fluid communication with the cavity region, and a portion of the through hole is configured to engage with a portion of a mating engagement feature of the interchangeable faceplate to form a fluid impermeable seal.

6. The in-ear audio device of claim 1, wherein the engagement feature comprises one or more engagement regions, and the one or more engagement regions are configured to receive one or more bayonet tabs formed on the interchangeable faceplate.

7. An in-ear audio device, comprising:

a shell body comprising:

a rotationally symmetric engagement feature comprising:

one or more notches;

one or more ridge regions positioned adjacent to one or more notches, wherein the one or more ridge regions are formed on a mounting region on an external surface of the shell body, and wherein the one or more notches of the rotationally symmetrical engagement feature are configured to receive one or more bayonet tabs of an interchangeable faceplate; and a slot disposed underneath each of the one or more ridge regions, wherein each slot is formed such that a bottom surface of an adjacent notch is coextensive with a bottom surface of the slot.

8. The in-ear audio device of claim 7, wherein the one or more ridge regions has a height from a back surface of the shell body of between 0.5 mm and 3 mm.

9. The in-ear audio device of claim 7, wherein the interchangeable faceplate has a thickness at its thickest point between 3 mm and between 15 mm.

10. The in-ear audio device of claim 7, wherein the shell body has a peripheral edge that is configured to align with a peripheral edge of an external surface of the interchangeable faceplate.

11. The in-ear audio device of claim 7, wherein the shell body has a peripheral edge that is configured to not align with a peripheral edge of the external surface of the interchangeable faceplate.

12. The in-ear audio device of claim 7, wherein the interchangeable faceplate comprises an acrylic sheet, and the one or more bayonet tabs comprise plastic.

13. An interchangeable faceplate for mounting on an in-ear audio device, comprising:

a body having a first surface and a second surface opposite the first surface; and a device engagement mechanism formed on the first surface of the body, the device engagement mechanism comprising one or more engagement features extending in a first direction, wherein the one or more engagement features are configured to positively engage with a rotationally symmetric engagement feature of an in-ear audio device; and one or more attachment features formed in or on the body, wherein the one or more attachment features are configured to support an adornment.

14. The interchangeable faceplate of claim 13, wherein the body further comprises an electronic device that is configured to send or receive an electronic signal.

15. The interchangeable faceplate of claim 13, wherein the body comprises one or more electrical contacts that are configured to contact mating electrical contacts formed on the in-ear audio device.

16. The interchangeable faceplate of claim 13, wherein the body comprises one or more attachment features that are configured to receive and support one or more adornments.

17. The interchangeable faceplate of claim 13, wherein the body comprises one or more attachment features that are configured to support the weight of an adornment attached to the body.

18. The interchangeable faceplate of claim 13, wherein a peripheral edge of the body is configured to align with a peripheral edge of an external surface of the in-ear audio device.

19. The interchangeable faceplate of claim 13, wherein a peripheral edge of the body is configured to not align with a peripheral edge of an external surface of the in-ear audio device.

20. The interchangeable faceplate of claim 13, wherein the first surface has a contour that does not follow the contour of an exposed outer surface of the in-ear audio device.

21. The interchangeable faceplate of claim 13, wherein the first surface has a contour that follows the contour of an exposed outer surface of the in-ear audio device.

* * * * *